US009653273B2

(12) United States Patent
Loyd et al.

(10) Patent No.: US 9,653,273 B2
(45) Date of Patent: May 16, 2017

(54) ION OPTICAL ELEMENTS

(71) Applicant: DH TECHNOLOGIES DEVELOPMENT PTE. LTD., Singapore (SG)

(72) Inventors: William Morgan Loyd, Sugar Land, TX (US); Alexandre Loboda, Thornhill (CA); Gregor Sprah, Mississauga (CA); Igor V. Chernushevich, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 178 days.

(21) Appl. No.: 14/650,242

(22) PCT Filed: Dec. 6, 2012

(86) PCT No.: PCT/IB2012/002615

§ 371 (c)(1),
(2) Date: Jun. 5, 2015

(87) PCT Pub. No.: WO2013/098612

PCT Pub. Date: Jul. 4, 2013

(65) Prior Publication Data

US 2015/0318156 A1 Nov. 5, 2015

Related U.S. Application Data

(60) Provisional application No. 61/582,071, filed on Dec. 30, 2011.

(51) Int. Cl.

| | |
|---|---|
| ***H01J 49/06*** | (2006.01) |
| ***H01J 49/26*** | (2006.01) |
| ***H01J 49/40*** | (2006.01) |

(52) U.S. Cl.
CPC ..... *H01J 49/068* (2013.01); *H01J 49/26* (2013.01); *H01J 49/40* (2013.01)

(58) Field of Classification Search
USPC ..... 250/396 R, 292, 293, 305
See application file for complete search history.

(56) References Cited

U.S. PATENT DOCUMENTS 5,194,732 A * 3/1993 Bateman ..... H01J 49/025 250/294
7,700,914 B2 4/2010 Yoshimura et al.
(Continued)

FOREIGN PATENT DOCUMENTS

JP 2002015699 A 1/2002
WO 0113405 A1 2/2001

OTHER PUBLICATIONS

PCT International Search Report, PCT/IB2012/002615, mailed Apr. 25, 2013 (3 pages).
(Continued)

*Primary Examiner* — Kiet T Nguyen

(57) ABSTRACT

Ion optics devices and related methods of making and using the same are disclosed herein that generally involve forming a plurality of electrode structures on a single substrate. An aspect ratio of the structures relative to a plurality of recesses which separate the structures can be selected so as to substantially prevent ions passing through the finished device from contacting exposed, electrically-insulating portions of the substrate. The substrate material can be a material that is relatively inexpensive and easy to machine into complex shapes with high precision (e.g., a printed circuit board material). In some embodiments, discrete ion optical elements are disclosed which can be formed from a core material to which an electrically-conductive coating is applied, the core material being relatively inexpensive and easy to machine with high precision. The coating can be
(Continued)

configured to substantially prevent outgassing from the core under the vacuum conditions typically experienced in a mass spectrometer.

19 Claims, 16 Drawing Sheets

(56) References Cited

U.S. PATENT DOCUMENTS

| | | | |
|---|---|---|---|
| 7,829,844 | B2 | 11/2010 | Miyata et al. |
| 2009/0078866 | A1 | 3/2009 | Li et al. |

OTHER PUBLICATIONS

PCT International Preliminary Report on Patentability and Written Opinion, PCT/IB2012/002615, issued Jul. 1, 2014 (7 pages).

* cited by examiner

ION OPTICAL ELEMENTS

RELATED APPLICATIONS

This application is a national stage filing under 35 U.S.C. 371 of PCT/IB2012/002615 filed on Dec. 6, 2012, which designates the U.S. and which claims the benefit and priority from U.S. Provisional Application Ser. No. 61/582,071, filed on Dec. 30, 2011, the entire contents of which are incorporated by reference herein.

FIELD

The applicant's teachings relate to ion optical elements and related methods of making and using such elements, for example in the field of mass spectrometry.

BACKGROUND

A number of devices used in mass spectrometry and other fields involve a high number of ion optical elements that must be manufactured and assembled with a great deal of precision. For example, devices such as time-of-flight reflectrons, time-of-flight accelerators, ion funnels, ion tunnels, ion mobility columns, ion mirrors, and so forth can comprise periodic structures formed by many electrodes which are separated from one another by insulating spacers.

FIG. 1 illustrates a prior art ion mirror 10 that includes a plurality of axially-aligned ring-shaped electrodes 12 that define an interior volume 14. Insulating spacers 16 are disposed between adjacent electrodes 12, and electric potentials are applied to the electrodes 12 by a controller 18 to generate an electromagnetic field within the interior volume 14, thereby influencing an ion beam passing therethrough. In the ion mirror 10 of FIG. 1, each electrode 12 must be individually machined from a solid piece of electrically-conductive stock material, such as stainless steel or nickel-plated aluminum. It can be very difficult and expensive to machine such materials with the requisite degree of accuracy. The difficulty and expense are compounded by the need to assemble a large number of discrete components with very tight tolerances.

In CORNISH et al., "Miniature Time-Of-Flight Mass Spectrometer Using A Flexible Circuitboard Reflector," Rapid Communications in Mass Spectrometry 14, 2408-2411 (2000), the entire content of which is incorporated herein by reference, an ion reflector is constructed by depositing a series of thin-copper traces on a flexible circuit board substrate. The substrate is then rolled into a tube with the copper traces facing inward to form ring-shaped electrodes. One disadvantage with such a structure is that at least some of the ions passing through the ion reflector collide with the exposed substrate regions between the copper traces. Over time, this can lead to a buildup of electrical charge on said regions and to the production of corresponding electromagnetic fields, which can have an unintended and undesired influence on the ion beam passing through the reflector.

U.S. Pat. No. 6,316,768 to Rockwood et al., entitled "PRINTED CIRCUIT BOARDS AS INSULATED COMPONENTS FOR A TIME OF FLIGHT MASS SPECTROMETER," the entire content of which is incorporated herein by reference, purportedly addresses this concern by coating the exposed regions of substrate with a partially conductive coating that provides a discharge path to ground. Although this technique is said to prevent charge buildup between electrodes, it adds additional complexity, time, and expense to the manufacturing process, and reduces the durability and lifespan of the finished device.

Accordingly, a need exists for improved ion optical elements and related methods of making and using the same.

SUMMARY

In one aspect of at least one embodiment of the applicant's teachings, an ion optical element is provided that can comprise a substrate that can comprise first and second opposed surfaces and a plurality of protrusions extending from said first surface, each protrusion having a top surface, at least one sidewall, and an electrically-conductive coating disposed on said top surface and at least a portion of said at least one sidewall. The substrate can also comprise at least one recess separating said protrusions, each recess having a portion of said first surface as a floor thereof. A depth of each recess can be at least about one half of a width of said recess.

Related aspects of at least one embodiment of the applicant's teachings provide an ion optical element, e.g., as described above, in which said top surface of at least some of said protrusions is planar.

Related aspects of at least one embodiment of the applicant's teachings provide an ion optical element, e.g., as described above, in which said top surface of at least some of said protrusions is perpendicular to said at least one sidewall.

Related aspects of at least one embodiment of the applicant's teachings provide an ion optical element, e.g., as described above, in which said top surface of at least some of said protrusions is curved.

Related aspects of at least one embodiment of the applicant's teachings provide an ion optical element, e.g., as described above, in which said at least one sidewall of at least some of said protrusions is curved.

Related aspects of at least one embodiment of the applicant's teachings provide an ion optical element, e.g., as described above, in which at least some of said protrusions comprise an electrically-conductive via extending through the substrate from the electrically-conductive coating of the protrusion to an electrically-conductive pad formed on said second surface.

Related aspects of at least one embodiment of the applicant's teachings provide an ion optical element, e.g., as described above, in which the via extends from a portion of the electrically-conductive coating disposed on the top surface of the protrusion to said pad.

Related aspects of at least one embodiment of the applicant's teachings provide an ion optical element, e.g., as described above, in which the via extends from a portion of the electrically-conductive coating disposed on the at least one sidewall of the protrusion to said pad.

Related aspects of at least one embodiment of the applicant's teachings provide an ion optical element, e.g., as described above, in which said pad is coupled to at least one of a resistor, a resistive film, and a power supply configured to apply an electric potential thereto.

Related aspects of at least one embodiment of the applicant's teachings provide an ion optical element, e.g., as described above, that can further comprise a vent extending through the substrate from the floor of said at least one recess to the second surface that permits gas flow therethrough.

Related aspects of at least one embodiment of the applicant's teachings provide an ion optical element, e.g., as described above, in which the substrate comprises any of an electrically-insulating material and a semi-conducting material.

Related aspects of at least one embodiment of the applicant's teachings provide an ion optical element, e.g., as described above, in which the substrate comprises a printed circuit board material.

Related aspects of at least one embodiment of the applicant's teachings provide an ion optical element, e.g., as described above, in which the substrate comprises any of ceramics, organic polymers, glass, machinable ceramics, and materials used in 3D printing.

Related aspects of at least one embodiment of the applicant's teachings provide an ion optical element, e.g., as described above, in which the printed circuit board material is selected from the group consisting of laminated polyamides, G-10, Teflon-based materials, phenolic cotton FR-2, and woven glass FR-4.

Related aspects of at least one embodiment of the applicant's teachings provide an ion optical element, e.g., as described above, in which the electrically-conductive coating comprises a non-oxidizing metal.

Related aspects of at least one embodiment of the applicant's teachings provide an ion optical element, e.g., as described above, in which the non-oxidizing metal comprises at least one of gold, nickel, platinum, palladium, titanium, stainless steel, tungsten, copper, and molybdenum.

Related aspects of at least one embodiment of the applicant's teachings provide an ion optical element, e.g., as described above, in which the ion optical element comprises at least one of a time-of-flight reflectron, a time-of-flight accelerator, an ion funnel, an ion tunnel, a multi-element ion optics lens, and an ion mobility column.

In another aspect of at least one embodiment of the applicant's teachings, an ion optical element, such as an ion guide, for use in a mass spectrometer is provided, which can comprise an electrically-insulating substrate having a plurality of protrusions extending therefrom and a plurality of recesses separating each of said protrusions, each of said protrusions having an electrically-conductive coating disposed thereon to form an electrode. The ion guide can also comprise a channel bounded at least in part by said substrate into which said electrodes protrude and through which ions can pass, and a controller configured to apply electric potentials to each of said electrodes to generate an electromagnetic field within the channel. Said recesses can have a depth sufficient to substantially prevent ions passing through the channel from contacting a floor surface of said recesses.

Related aspects of at least one embodiment of the applicant's teachings provide an ion optical element, e.g., as described above, in which the substrate is substantially ring-shaped.

In another aspect of at least one embodiment of the applicant's teachings, a method of manufacturing an ion optical element is provided, which can comprise selectively removing portions of a printed circuit board substrate to generate a plurality of protrusions, said protrusions being separated from one another by a plurality of recesses each having a depth that is at least about one half of its width, each of said protrusions having a top surface and at least one sidewall. The method can also comprise depositing an electrically-conductive coating on said top surface and at least a portion of said at least one sidewall of each of said protrusions, and forming a non-coated region between each of said protrusions such that the protrusions define a plurality of discrete electrodes.

Related aspects of at least one embodiment of the applicant's teachings provide a method, e.g., as described above, in which said electrically-conductive coating is deposited using at least one of electroplating and vapor deposition.

Related aspects of at least one embodiment of the applicant's teachings provide a method, e.g., as described above, in which each of said non-coated regions is formed by applying a mask to said non-coated region before depositing the electrically-conductive coating and removing the mask after depositing the electrically-conductive coating.

Related aspects of at least one embodiment of the applicant's teachings provide a method, e.g., as described above, in which each of said non-coated regions is formed by depositing the electrically-conductive coating over floor surfaces of said recesses, and then selectively removing said coating from said floor surfaces.

Related aspects of at least one embodiment of the applicant's teachings provide a method, e.g., as described above, in which each of said non-coated regions is formed by etching portions of the electrically-conductive coating.

In another aspect of at least one embodiment of the applicant's teachings, an ion optical element is provided, which can comprise a plurality of electrodes positioned to be spaced apart from one another, each of said electrodes comprising a core comprising a printed circuit board material, the core having an aperture for passage of ions therethrough, and an electrically-conductive coating disposed over an entire exterior surface of said core.

Related aspects of at least one embodiment of the applicant's teachings provide an ion optical element, e.g., as described above, in which the electrically-conductive coating has a thickness of at least about 2 microns.

Related aspects of at least one embodiment of the applicant's teachings provide an ion optical element, e.g., as described above, in which the electrically-conductive coating comprises a plurality of layers.

Related aspects of at least one embodiment of the applicant's teachings provide an ion optical element, e.g., as described above, in which the electrically-conductive coating comprises a first layer deposited directly onto the core and a second layer deposited onto the first layer.

Related aspects of at least one embodiment of the applicant's teachings provide an ion optical element, e.g., as described above, in which the first layer comprises a copper coating and the second layer comprises a gold coating.

In another aspect of at least one embodiment of the applicant's teachings, an ion optical element configured for positioning in a vacuum chamber of a mass spectrometer is provided. The ion optical element can comprise a plurality of electrodes positioned to be spaced apart from one another. Each of said electrodes can comprise a core comprising a printed circuit board material, the core having an aperture for passage of ions therethrough, and an electrically-conductive coating disposed over a selected surface area of said core such that said coating substantially prevents outgassing from said printed circuit board material under vacuum conditions.

Related aspects of at least one embodiment of the applicant's teachings provide an ion optical element, e.g., as described above, in which the electrically-conductive coating is disposed over at least about 50 percent, at least about 60 percent, at least about 70 percent, at least about 80 percent, at least about 90 percent, and/or at least about 100 percent of an exposed surface area of said core.

Related aspects of at least one embodiment of the applicant's teachings provide an ion optical element, e.g., as described above, in which the electrically-conductive coating is disposed over at the entire exposed surface area of said core.

Related aspects of at least one embodiment of the applicant's teachings provide an ion optical element, e.g., as described above, in which the electrically-conductive coating has a thickness of at least about 2 microns.

Related aspects of at least one embodiment of the applicant's teachings provide an ion optical element, e.g., as described above, in which the electrically-conductive coating comprises a plurality of layers.

Related aspects of at least one embodiment of the applicant's teachings provide an ion optical element, e.g., as described above, in which the electrically-conductive coating comprises a first layer deposited directly onto the core and a second layer deposited onto the first layer.

Related aspects of at least one embodiment of the applicant's teachings provide an ion optical element, e.g., as described above, in which the first layer comprises a copper coating and the second layer comprises a gold coating.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DESCRIPTION OF VARIOUS EMBODIMENTS

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Ion optics devices and related methods of making and using the same are disclosed herein that generally involve forming a plurality of electrode structures on a single substrate. An aspect ratio of the structures relative to a plurality of recesses which separate the structures can be selected so as to substantially prevent ions passing through the finished device from contacting exposed, electrically-insulating portions of the substrate, and/or to mitigate the effect of unwanted fields that may develop when ions do contact such portions. The substrate material can be a material that is relatively inexpensive and easy to machine into complex shapes with high precision (e.g., a printed circuit board material, 3D printed material). In some embodiments, discrete ion optical elements are disclosed which can be formed from a core material to which an electrically-conductive coating is applied, the core material being relatively inexpensive and easy to machine with high precision. The coating can be configured to substantially prevent outgassing from the core under the vacuum conditions typically experienced in a mass spectrometer.

Figure 1:
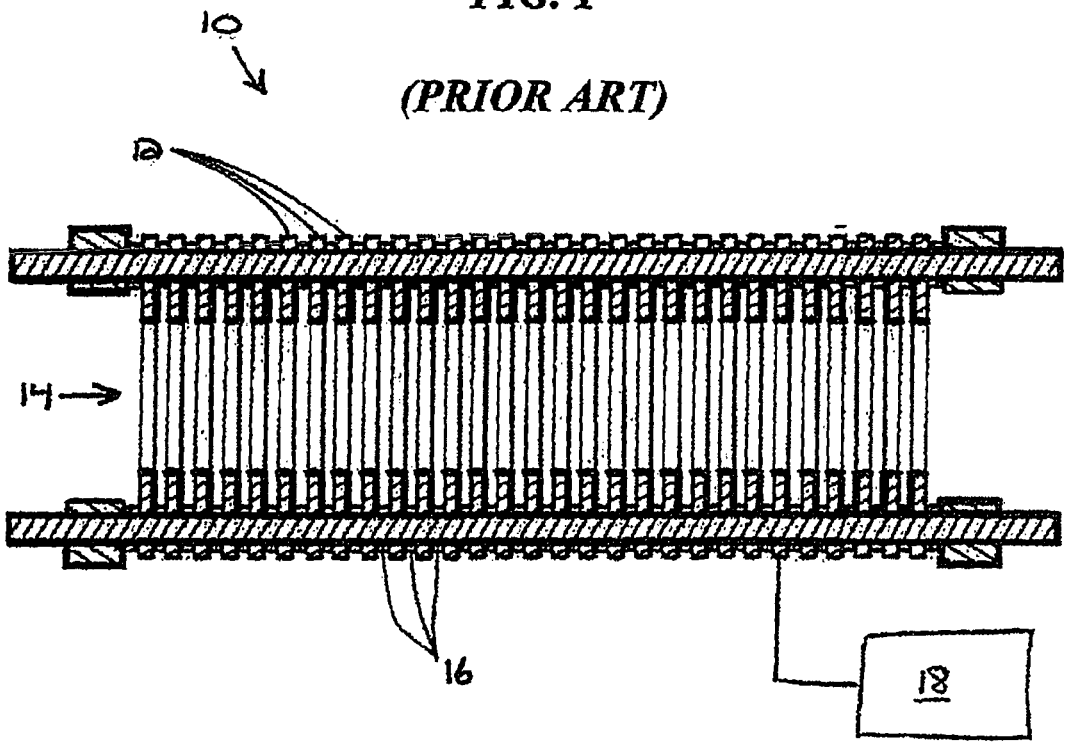
FIG. 1 (PRIOR ART)
FIG. 1 is a schematic cross-sectional view of a prior art ion mirror.
Figure 2:
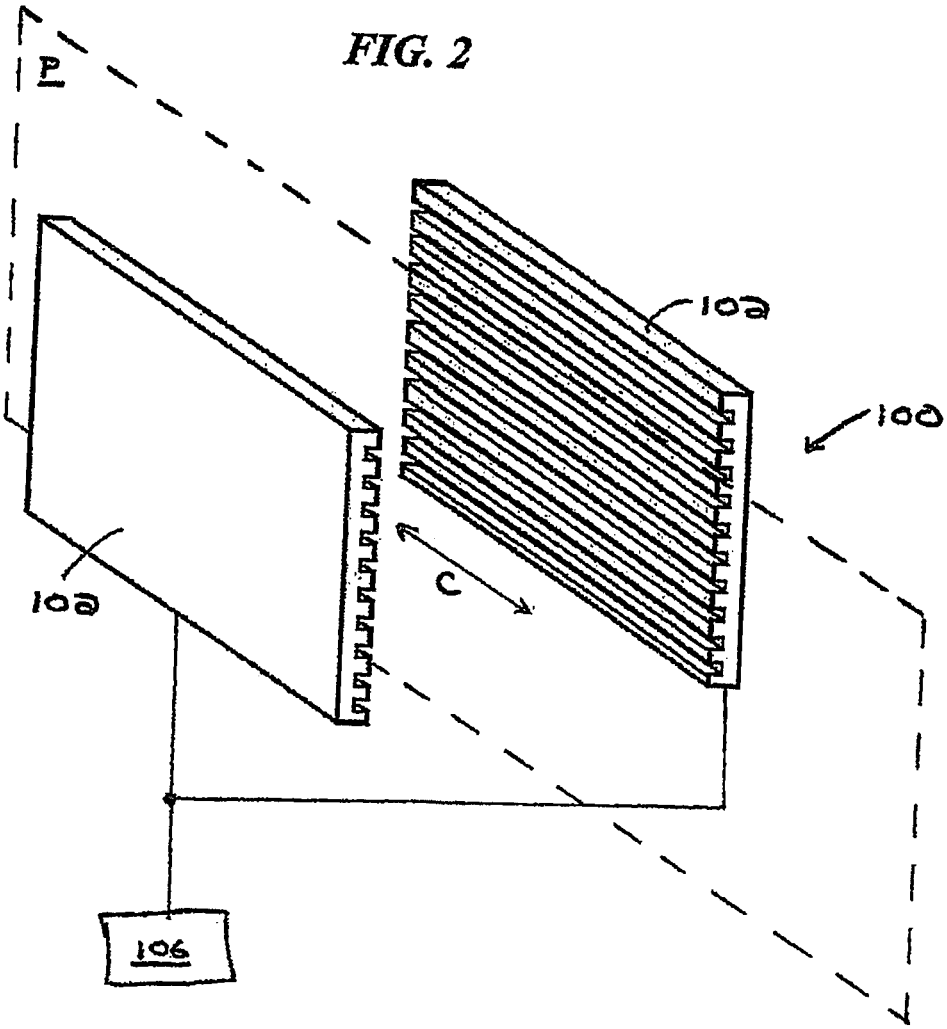
FIG. 2 is a schematic perspective view of one exemplary embodiment of an ion optics device according to the applicant's teachings.

FIG. 2 is a schematic perspective view of one exemplary embodiment of an ion optics device 100 according to the applicant's teachings. As shown, the device 100 can comprise first and second parallel plates 102 positioned across a plane of symmetry P from one another. The two plates 102 can define a channel C therebetween through which an ion beam can be directed. A controller 106 can be configured to apply electric potentials to a plurality of electrodes formed on the plates 102 to generate an electric field within the channel C and thereby manipulate or influence an ion beam passing therethrough.

Figure 3A:
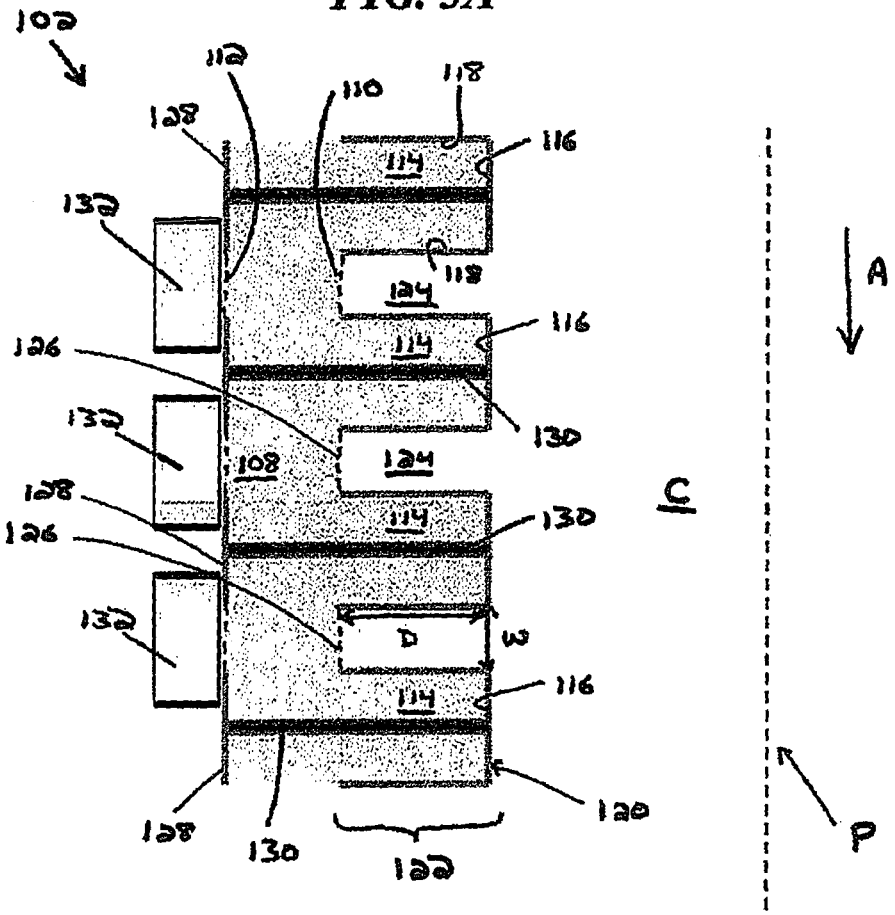
FIG. 3A is a schematic cross-sectional view of one exemplary embodiment of an ion optics device according to the applicant's teachings.

As shown in FIG. 3A, each plate 102 can comprise a substrate 108 having a first surface 110 oriented towards the channel C and a second, opposed surface 112 oriented away from the channel C. The substrate 108 can comprise any of a variety of electrically-insulating or semi-conducting materials known in the art and various combinations thereof. In some embodiments, the substrate 108 can comprise a printed circuit board material. Exemplary printed circuit board materials can comprise, without limitation, epoxy resins, polytetrafluoroethylene, FR-1, FR-2 (phenolic cotton paper), FR-3 (cotton paper and epoxy), FR-4 (woven glass and epoxy), FR-5 (woven glass and epoxy), FR-6 (matte glass and polyester), G-10 (woven glass and epoxy), CEM-1 (cotton paper and epoxy), CEM-2 (cotton paper and epoxy), CEM-3 (woven glass and epoxy), CEM-4 (woven glass and epoxy), CEM-5 (woven glass and polyester), laminated polyamides, and Teflon-based materials. It will be appreciated that any of a variety of other printed circuit board materials known in the art can also be employed. In some embodiments, the substrate can comprise any of ceramics, organic polymers, glass, machinable ceramics, and materials used in 3D printing.

A plurality of protrusions 114 can extend from the first surface 110, each of which can comprise a top surface 116 and first and second sidewalls 118. An electrically-conductive coating 120 can be disposed on the top surface 116 and at least a portion of the first and second sidewalls 118 of each protrusion 114 to form an electrode 122. The electrically-conductive coating 120 can comprise any of a variety of non-oxidizing electrically-conductive materials, such as gold, nickel, platinum, palladium, titanium, molybdenum, and various alloys or combinations thereof. The electrically-conductive coating 120 can have any of a variety of thicknesses, e.g., as small as a monolayer of conductive material (~0.1 nm), at least about 2 microns, at least about 4 microns, at least about 10 microns, at least about 50 microns, at least about 100 microns, and/or at least about 1000 microns.

A plurality of recesses 124 can be formed between the protrusions 114, each of which can be defined by the sidewalls 118 of the protrusions 114 and a portion of the first surface 110, which forms the floor 126 of the recess 124. At least a portion of the floor 126 of each recess 124 can remain exposed (e.g., with no electrically-conductive coating disposed thereon or applied thereto), such that an insulating region is formed between the electrodes 122 of adjacent protrusions 114. As a result, the coated portions of each protrusion 114 can define a plurality of discrete electrodes 122 to which electric potentials can be independently applied to generate an electromagnetic field within the channel C.

A plurality of electrically-conductive pads 128 can be formed on or in the second surface 112 of the substrate 108. The substrate 108 can also include one or more vias 130 extending therethrough to form an electrically-conductive path between each pad 128 and a corresponding electrode 122. Resistors 132 can be soldered to adjacent pads 128 to provide a conductive path between each electrode 122, and a supply voltage can then be applied to the resistor network by the controller 106 to produce a potential gradient across the substrate 108 and thereby generate the desired electric field within the channel C. It will be appreciated that any of a variety of other electrical components can be coupled to the pads 128, such as capacitors, diodes, Zener diodes, and so forth.

For purposes herein, the depth D of a recess 124 is the difference between the maximum extent to which the protrusions 114 that define the recess 124 extend towards the channel C and the maximum extent to which the floor 126 of the recess 124 extends towards the channel C. The depth of an exemplary recess is labeled in each of FIGS. 3A-3G.

Also for purposes herein, the width W of a recess 124 is the distance in the nominal direction of ion movement through the channel (as indicated by the arrow A in FIG. 3A) between the protrusions 114 which define the recess 124, at the mouth of the recess 124. The width of an exemplary recess is labeled in each of FIGS. 3A-3G.

The aspect ratio of the depth D of each recess 124 to the width W of each recess 124 can have any of a variety of values. In some embodiments, the aspect ratio of the depth D relative to the width W can be selected to substantially prevent ions passing through the channel C from contacting the exposed, non-coated portions of the recess floor 126 or protrusion sidewalls 118. In other words, the depth D can be sufficient to substantially prevent ions passing through the channel C from striking an electrically-insulating portion of the substrate 108 and building up a charge thereon, which can produce an electromagnetic field that can have unintended and undesired influence on the ion beam passing through the channel C. In addition, by having a sufficient depth D, even when a charge is inadvertently built up on the electrically-insulating portions of the substrate 108, the ion beam passing through the channel C is substantially unaffected because of its remoteness from said portions.

In some embodiments, the depth D can be at least about one half of the width W, at least about equal to the width W, at least about 2 times greater than the width W, at least about 3 times greater than the width W, at least about 5 times greater than the width W, and/or at least about 10 times greater than the width W.

In embodiments in which the electrically-conductive coating 120 does not extend all the way to the floors 126 of the recesses 124, a depth D1 can be defined as the depth to which the coating 120 does extend into the recesses 124. In such embodiments, the depth D1 can be at least about one half of the width W, at least about equal to the width W, at least about 2 times greater than the width W, at least about 3 times greater than the width W, at least about 5 times greater than the width W, and/or at least about 10 times greater than the width W.

In the illustrated embodiment of FIG. 3A, the top surface 116 of each protrusion 114 is substantially planar, as are the first and second sidewalls 118 of each protrusion 114. In addition, the top surface 116 is substantially perpendicular to the first and second sidewalls 118. Also, the width and spacing between the protrusions 114 is constant in the embodiment of FIG. 3A, and the plates 102 that define the channel C are symmetrical to one another. It will be appreciated, however, that any of a variety of other configurations are also possible. In particular, any configuration that can be formed from a substrate such as printed circuit board material can be used without departing from the scope of the applicant's teachings.

FIGS. 3B-3K schematically illustrate a number of exemplary variations from the embodiment of FIG. 3A. In these figures, like parts are designated with like reference numerals having an alphabetic suffix corresponding to the particular figure in which they are shown. For the sake of brevity, a detailed description of said parts is omitted, it being understood that said parts are the same as or similar to the corresponding parts described above, unless stated otherwise.

Figure 3B:
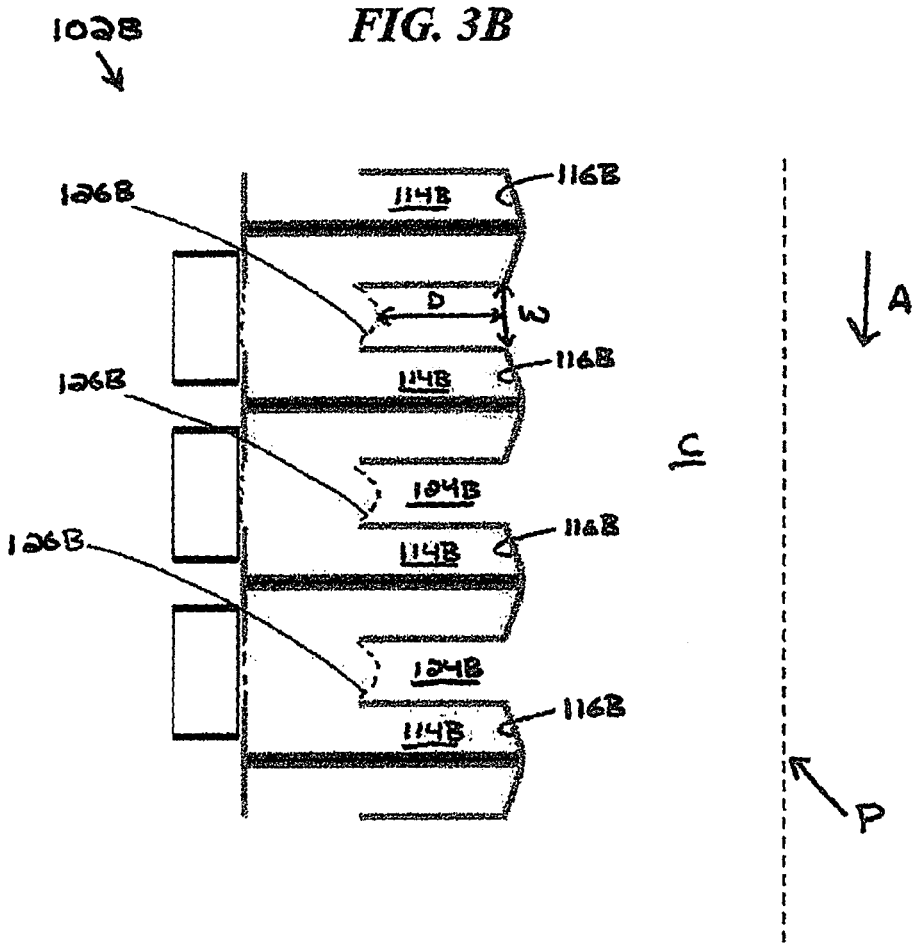
FIG. 3B is a schematic cross-sectional view of another exemplary embodiment of an ion optics device according to the applicant's teachings.

As shown in FIG. 3B, the top surfaces 116B of one or more of the protrusions 114B can be non-planar (e.g., curved or tapered). Alternatively, or in addition, the floors 126B of one or more of the recesses 124B can be non-planar (e.g., curved or tapered). In some embodiments, the floors 126B can be convex as shown, while in other embodiments the floors 126B can be concave, e.g., as a result of being milled into the substrate.

Figure 3C:
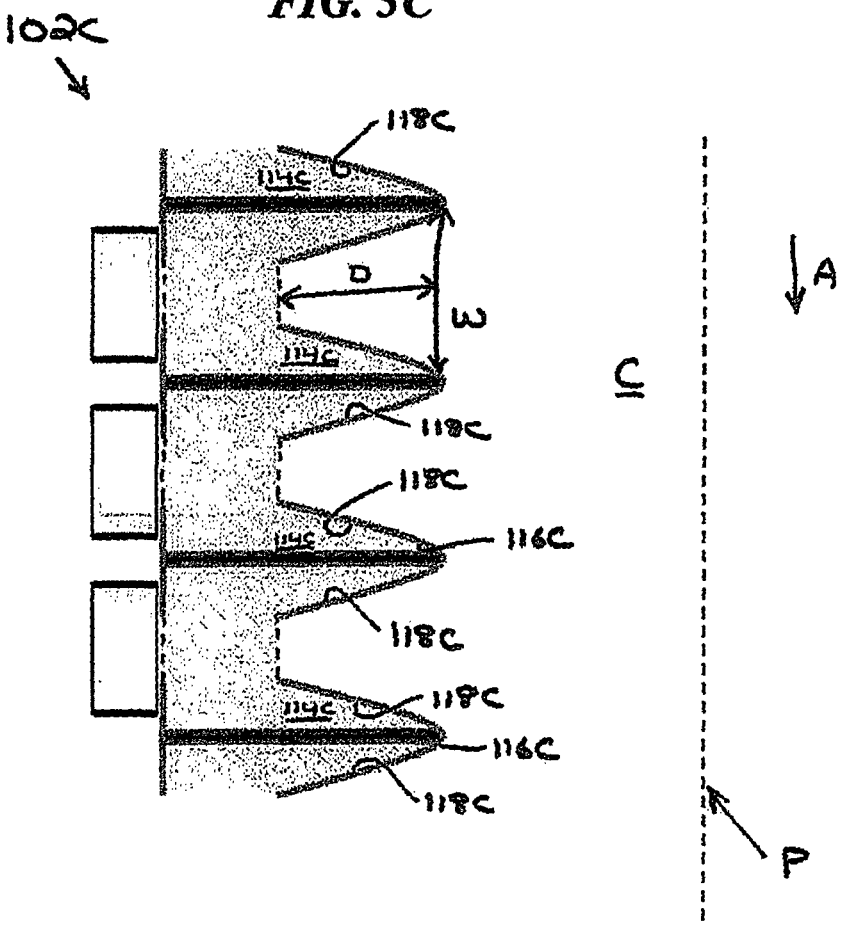
FIG. 3C is a schematic cross-sectional view of another exemplary embodiment of an ion optics device according to the applicant's teachings.

As shown in FIG. 3C, the top surface 116C and first and second sidewalls 118C of one or more of the protrusions 114C can together form a generally continuous curved surface.

Figure 3D:
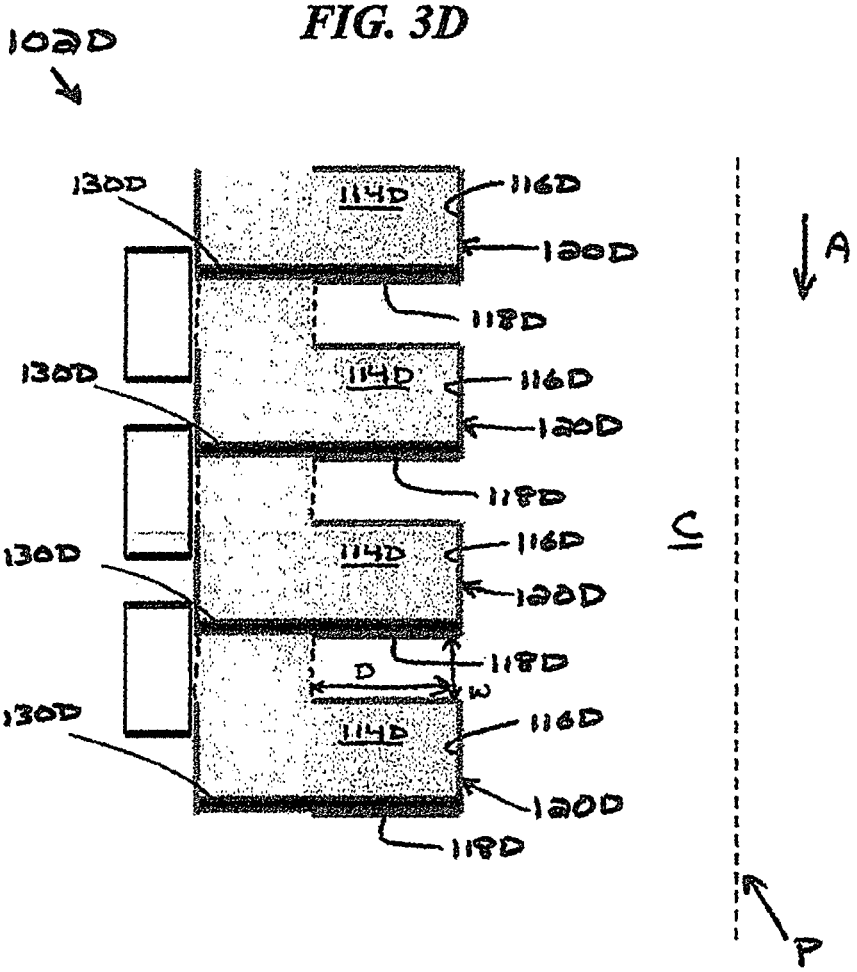
FIG. 3D is a schematic cross-sectional view of another exemplary embodiment of an ion optics device according to the applicant's teachings.

As shown in FIG. 3D, the vias 130D of one or more protrusions 114D can be placed adjacent to a sidewall 118D of the protrusion 114D, rather than being positioned substantially in the center of the protrusion as in the embodiment of FIG. 3A. This can permit the via 130D to merge with or bleed into the sidewall 118D. In some embodiments, the via 130D can terminate before breaching the top surface 116D of the protrusion 114D, and thus can be in contact only with the sidewall portion of the electrically-conductive coating 120D. In some cases, this can avoid field abnormalities that may otherwise result when the via extends all the way through the top surface of the protrusion and into direct contact with the electrically-conductive coating applied thereto. In addition to those shown and described herein, various other via locations, sizes, and shapes are also possible. For example, in some embodiments, the conductive coating can extend partially across the floor surface 126 (see FIG. 3A) of the recesses 124 and the via can be connected to the conductive coating at the floor surface 126.

Figure 3E:
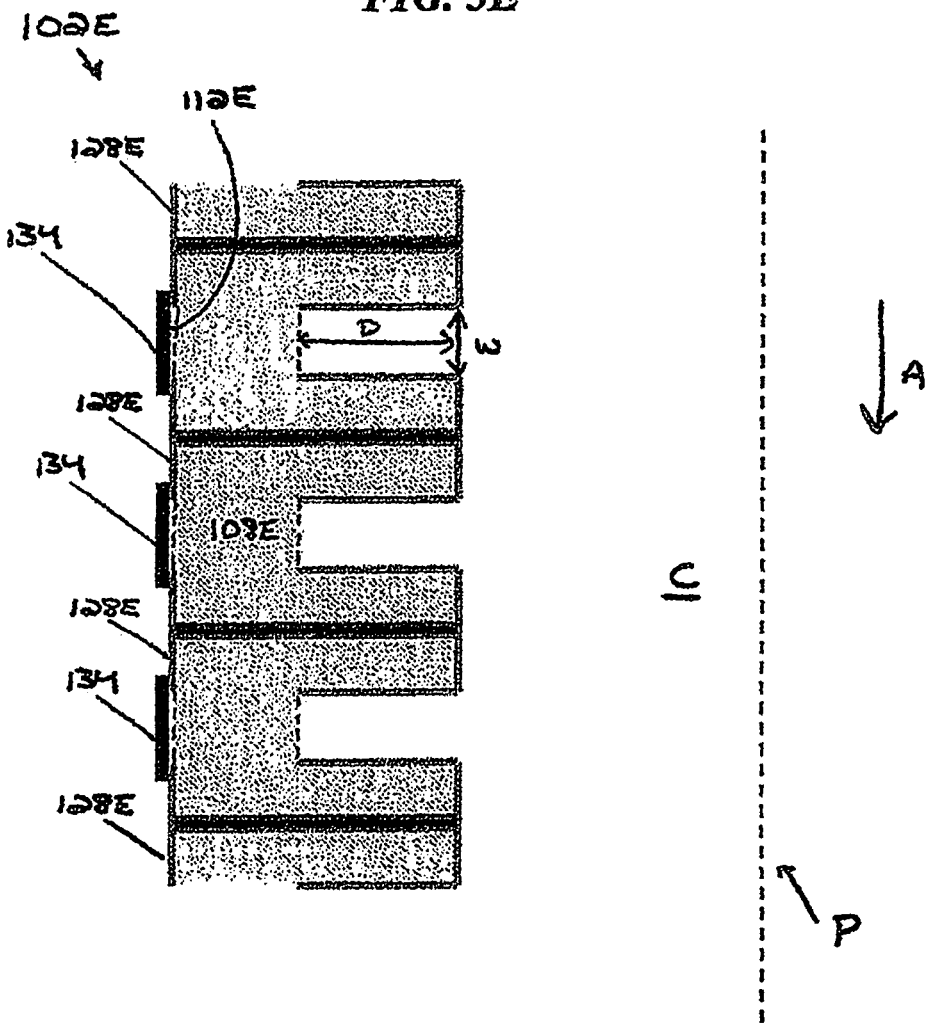
FIG. 3E is a schematic cross-sectional view of another exemplary embodiment of an ion optics device according to the applicant's teachings.

As shown in FIG. 3E, a resistive film 134 can be applied to the pads 128E formed in the second surface 112E of the substrate 108E instead of or in addition to, soldering resistors or other electrical components thereto as shown in FIG. 3A. In such embodiments, the resistive film 134 can provide the desired potential gradient without requiring the additional manufacturing step of soldering discrete resistor components to the substrate 108E or pads 128E. The resistive film 134 also can be, in some instances, more tolerant to pressure, temperature, impact, and vibration stresses to which the plate 102E may be subjected. Exemplary resistive film materials include aluminum, nichrome, constantan, gold, indium tin oxide, aluminum nitride, beryllium oxide, and various alloys or combinations thereof. Further exemplary materials include resistive inks that are used for manufacturing resistors by various technologies (e.g., thick film resistors, thin film resistors, metal film resistors, carbon film resistors, and so on).

Figure 3F:
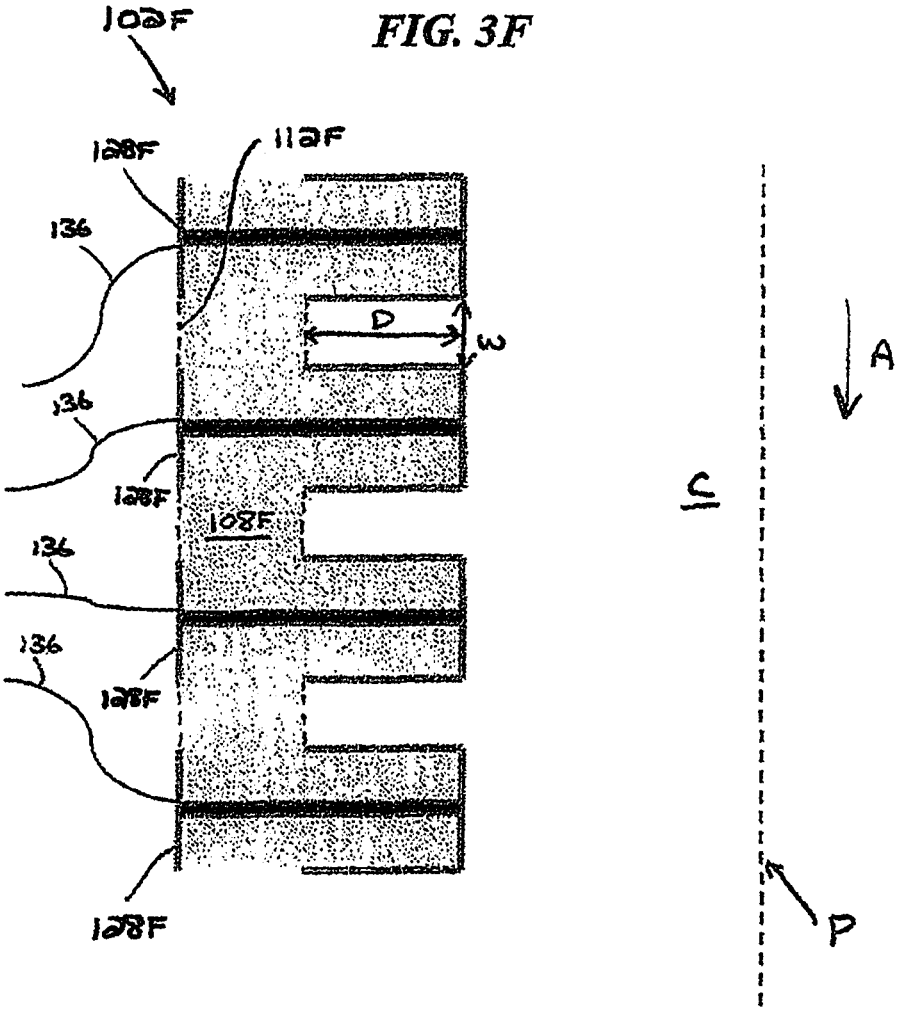
FIG. 3F is a schematic cross-sectional view of another exemplary embodiment of an ion optics device according to the applicant's teachings.

As shown in FIG. 3F, the pads 128F formed in the second surface 112F of the substrate 108F can be coupled via electrical leads or traces 136 to an external power supply or voltage divider circuit (not shown), instead of, or in additional to, having resistors or a resistive film applied directly thereto. Electrical connectors, zero insertion force connectors, and spring loaded connectors can be added to the ion optical element to simplify electrical coupling with an external power supply. When utilizing a multi-output power supply, in some embodiments, a multi-pin connector can be employed to connect the power supply to the pads 128F. In some embodiments, this can permit a greater degree of control and customization of the voltages applied to the electrodes and the resulting fields. Any of a variety of power supplies can be used, including RF power supplies and other sources of variable voltages.

Figure 3G:
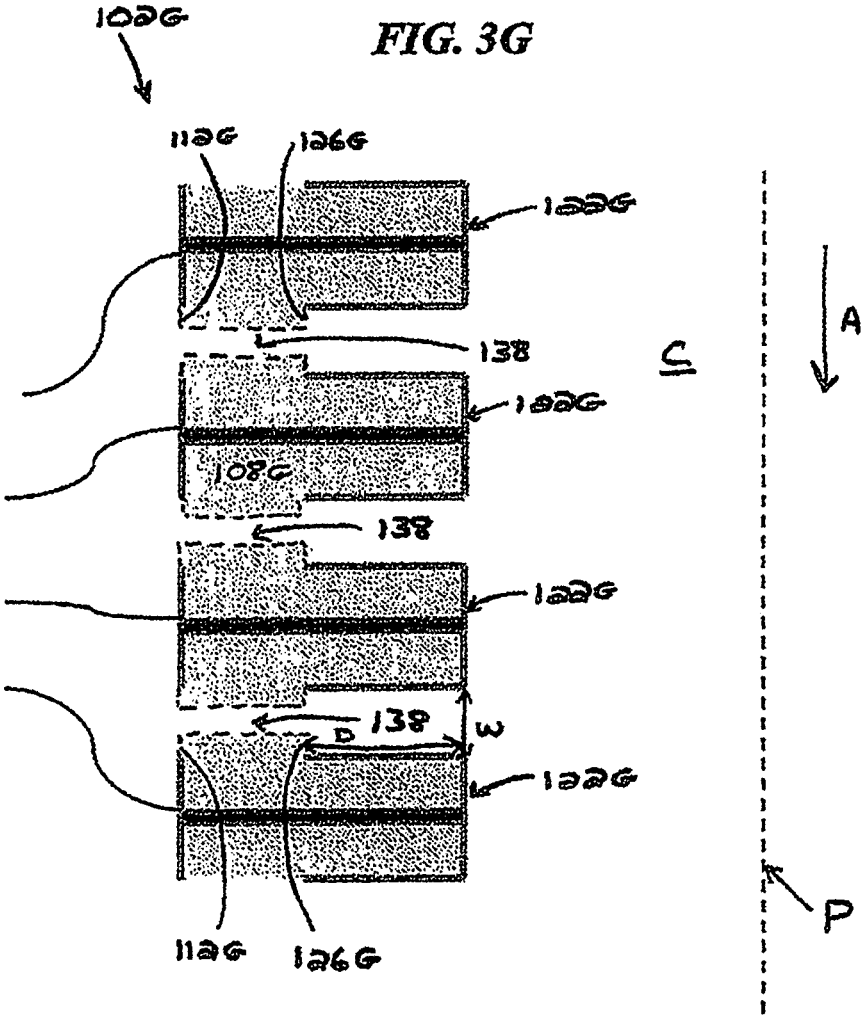
FIG. 3G is a schematic cross-sectional view of another exemplary embodiment of an ion optics device according to the applicant's teachings.

As shown in FIG. 3G, the substrate 108G can comprise one or more vents 138 extending therethrough to allow gas to be evacuated from the channel C or to allow an extra gas to be admitted to the channel C. In the illustrated embodiment, the vents 138 extend from the floor surface 126G of each recess, through the substrate 108G, to the second surface 112G of the substrate. In use, an ion beam comprising a plurality of ions dispersed in a carrier gas can be directed through the channel C. The dispersed ions can be retained within the channel C by electric fields generated in proximity to the electrodes 122G, while at least some of the carrier gas is permitted to escape through the vents 138.

Figure 3H:
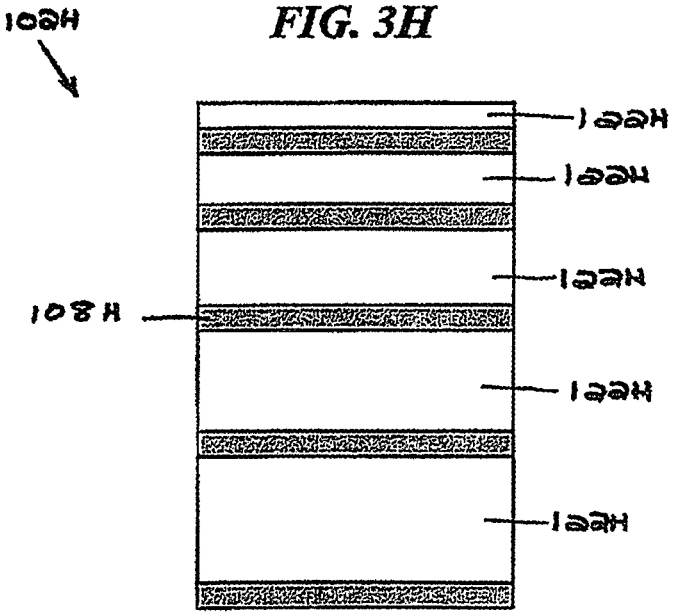
FIG. 3H is a schematic top view of another exemplary embodiment of an ion optics device according to the applicant's teachings.

As shown in FIG. 3H, the width of each electrode 122H need not necessarily be constant across the overall width of the substrate 108H.

Figure 3I:
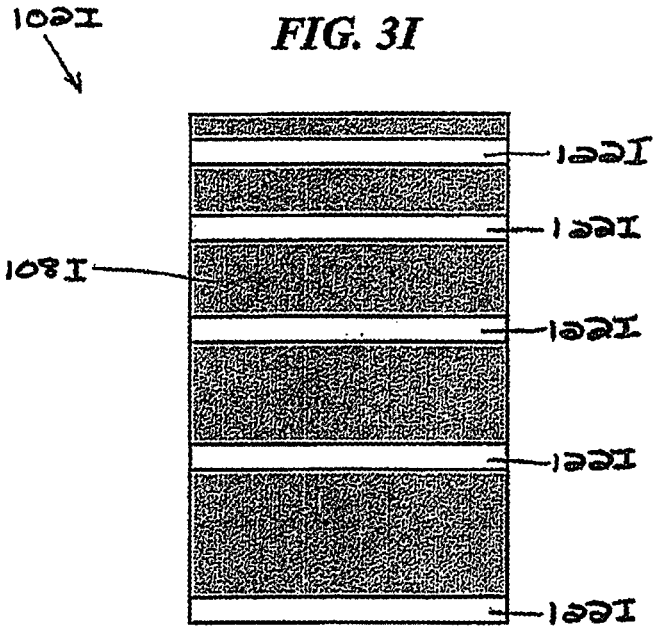
FIG. 3I is a schematic top view of another exemplary embodiment of an ion optics device according to the applicant's teachings.

As shown in FIG. 3I, the spacing between adjacent electrodes 122I need not necessarily be constant across the overall width of the substrate 108I.

Figure 3J:
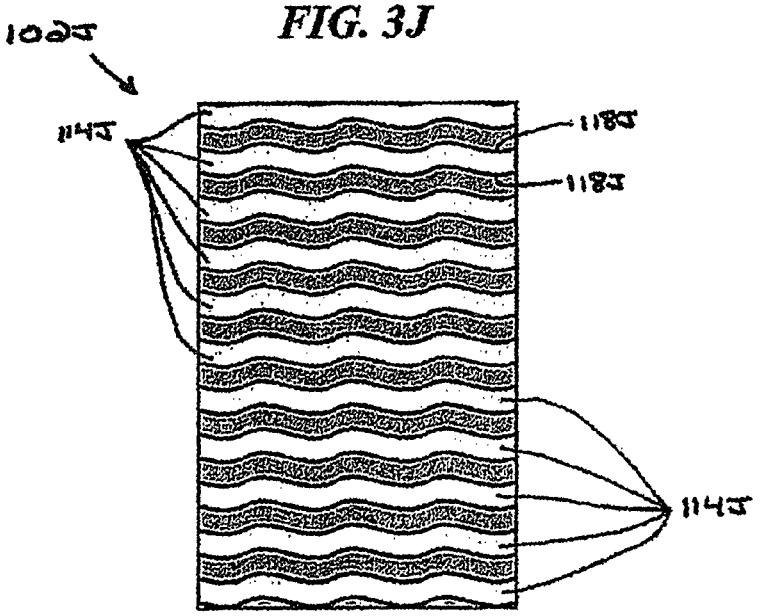
FIG. 3J is a schematic top view of another exemplary embodiment of an ion optics device according to the applicant's teachings.

As shown in FIG. 3J, the sidewalls 118J of the protrusions 114J can be non-planar in the length dimension.

Figure 3K:
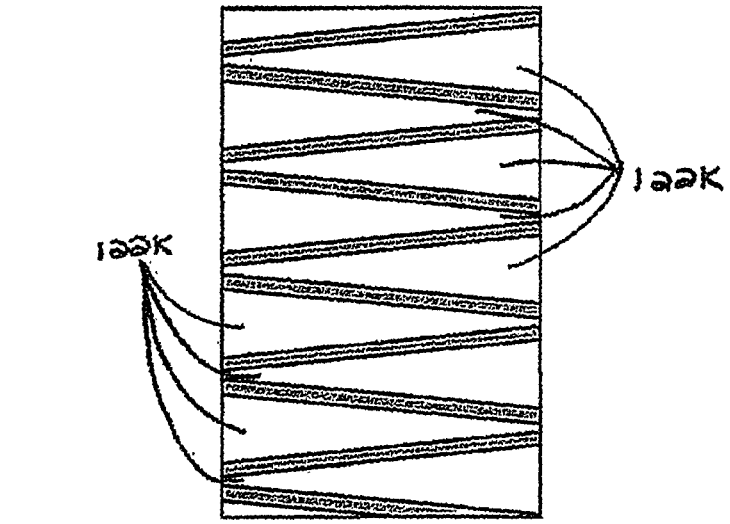
FIG. 3K is a schematic top view of, another exemplary embodiment of an ion optics device according to the applicant's teachings.

As shown in FIG. 3K, one or more electrodes 122K can have a width that varies in the length dimension.

Figure 4:
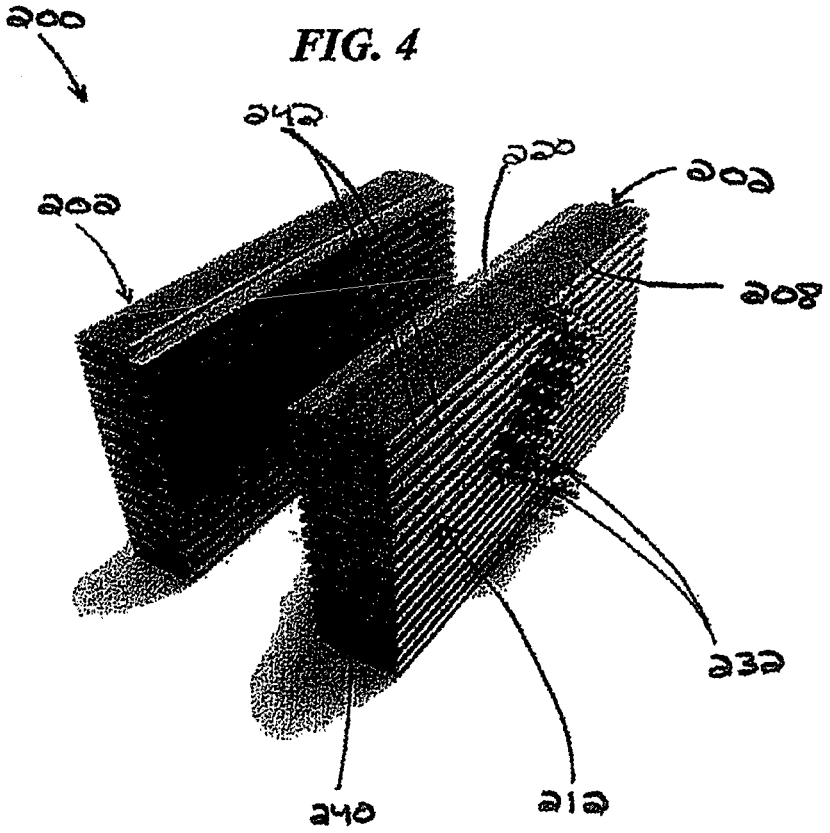
FIG. 4 is a perspective view of another exemplary embodiment of an ion optics device according to the applicant's teachings.

FIG. 4 is a perspective view of one exemplary embodiment of an ion optics device 200 according to the applicant's teachings having first and second parallel plates 202. The structure and function of the various elements of the device 200 are substantially similar to those of the device 100 described above, except as indicated. In the embodiment of FIG. 4, the electrically-conductive coating 220 applied to each protrusion extends around a side surface 240 of the substrate 208 to a linear trace 242 formed on the second surface 212. Resistors 232 or other electrical components can then be soldered across adjacent traces 242 as shown.

Figure 5:
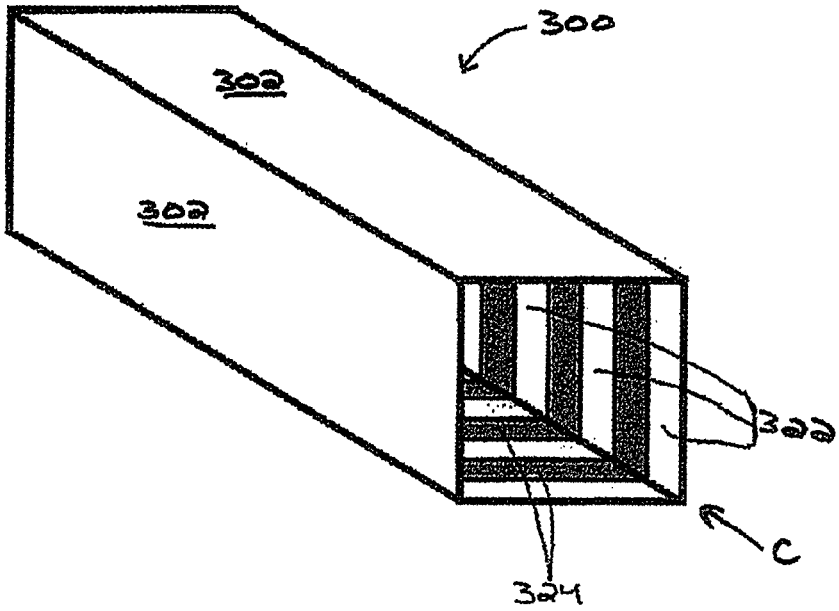
FIG. 5 is a schematic perspective view of another exemplary embodiment of an ion optics device according to the applicant's teachings.

In some of the embodiments described above, the ion optics device can comprise a parallel plate structure. In other embodiments, however, various other structures can be used. For example, as shown in FIG. 5, four plates 302 can be fastened together to form a rectangular tunnel-shaped ion optics device 300. The plates 302 can be oriented such that electrodes 322 formed thereon extend into an interior channel C of the device 300 through which an ion beam can be directed. In some embodiments, six plates can be fastened together to form a hexagonal tunnel, eight plates can be fastened together to form an octagonal tunnel, and so on.

Figure 6:
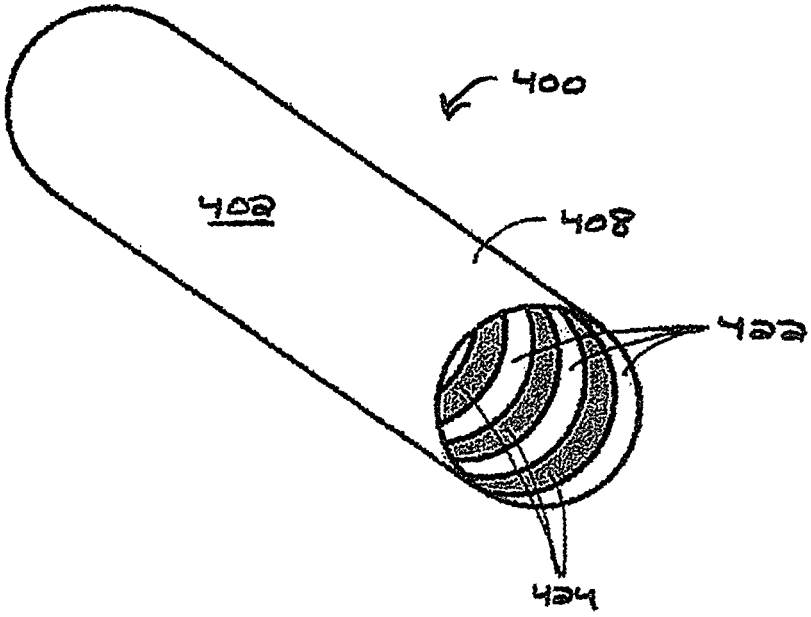
FIG. 6 is a schematic perspective view of another exemplary embodiment of an ion optics device according to the applicant's teachings.

In addition, as shown in FIG. 6, an ion optics device 400 can comprise a cylindrical, tube-shaped structure. In this embodiment, the desired electrode 422 pattern can be machined into the plate 402 while it is in a substantially planar configuration. A flexible substrate material can be used such that the substrate 408 can then be rolled into the final cylindrical configuration. In some embodiments, a cylindrical shaped substrate can be used from the outset and circular grooves can be cut on the inside wall to form protrusions. Conductive plating can be deposited on the circular walls. In some embodiments, a substrate that is rectangular (or hexagonal, etc.) on the outside and circular on the inside can be used.

It will be appreciated that various other shapes and configurations are possible without departing from the scope of the applicant's teachings, and that any of the variations disclosed above can be used in connection with the devices of FIGS. 5 and 6. In the embodiments illustrated in FIGS. 5 and 6, the electrodes 322, 422 extend from the plates 302, 402 such that recesses 324, 424 are formed therebetween, said recesses having a depth that is at least about one half of their width.

Figure 7:
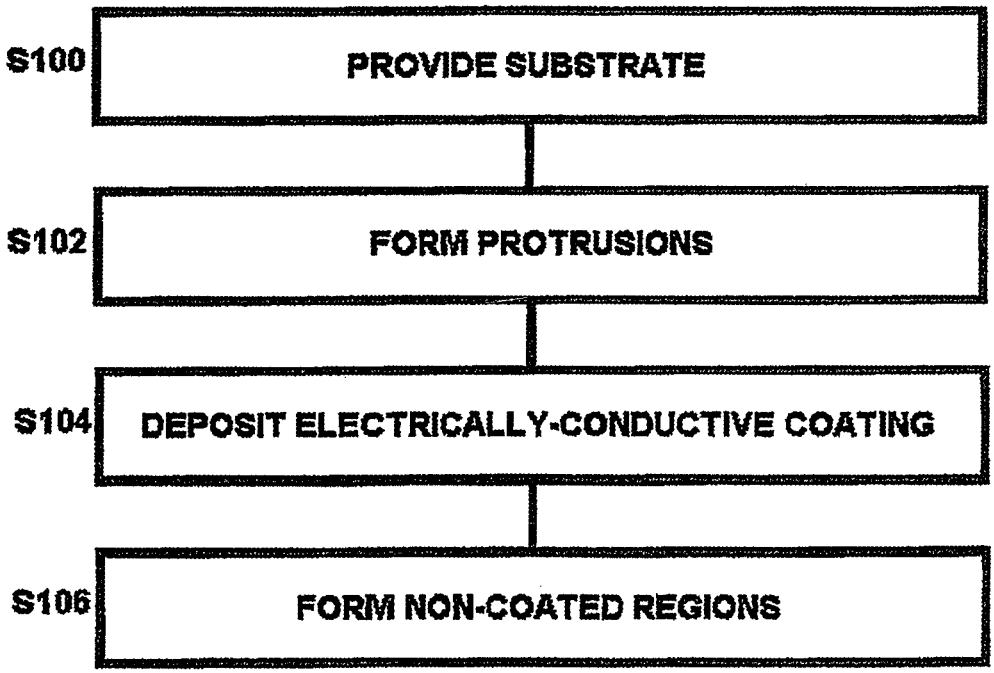
FIG. 7 is a schematic illustration of one exemplary method of manufacturing an ion optics device according to the applicant's teachings.

One exemplary method of manufacturing an ion optics device in accordance with the applicant's teachings is illustrated schematically in the flow chart of FIG. 7. While various methods disclosed herein are shown in relation to a flowchart or flowcharts, it should be noted that any ordering of method steps implied by such flowcharts or the description thereof is not to be construed as limiting the method to performing the steps in that order. Rather, the various steps of each of the methods disclosed herein can be performed in any of a variety of sequences. In addition, as the illustrated flowcharts are merely exemplary embodiments, various other methods that include additional steps or include fewer steps than illustrated are also within the scope of the applicant's teachings.

In step S100, a substrate is provided having the desired thickness and overall dimensions. In the case of a printed circuit board substrate, the substrate can be laminated to the desired thickness, and the conductive vias and conductive pads can be formed therein or thereon.

Thereafter, in step S102, portions of the substrate can be selectively removed to generate a plurality of protrusions in a surface of the substrate. The portions of the substrate can be removed by milling, drilling, planing, routing, sawing, cutting, etching, or any other process known in the art. Alternatively, in some embodiments, the protrusions can be formed on the substrate using 3D printing or other techniques known in the art.

Thereafter, in step S104, an electrically-conductive coating can be deposited on the top surfaces and at least a portion of the sidewalls of the protrusions. The coating can be applied using electroplating, vapor-deposition, or other suitable methods.

Thereafter, in step S106, a non-coated region can be formed between each of the protrusions such that the protrusions define a plurality of discrete electrodes. The non-coated region can include some or all of the floor surface of the recesses, and can also include at least a portion of the sidewalls of the protrusions. In some embodiments, the non-coated regions can be formed by removing a mask that had been applied to the non-coated regions prior to the coating deposition of step S104. In other embodiments, the non-coated regions can be formed by selectively removing the electrically-conductive coating from the floor surfaces of the recesses after the coating is applied to said floor surfaces in step S104. Such selective removal can be achieved using any of the methods described above for selectively removing portions of the substrate.

Substrates of the type discussed above (e.g., substrates that comprise a printed circuit board material) can also be used to manufacture discrete ion optical elements, which can subsequently be assembled to form a multi-element ion optics device.

Figure 8A:
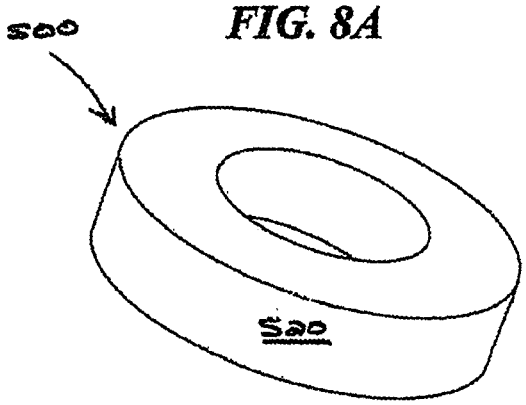
FIG. 8A is a schematic perspective view of one exemplary embodiment of an ion optical element according to the applicant's teachings.
Figure 8B:
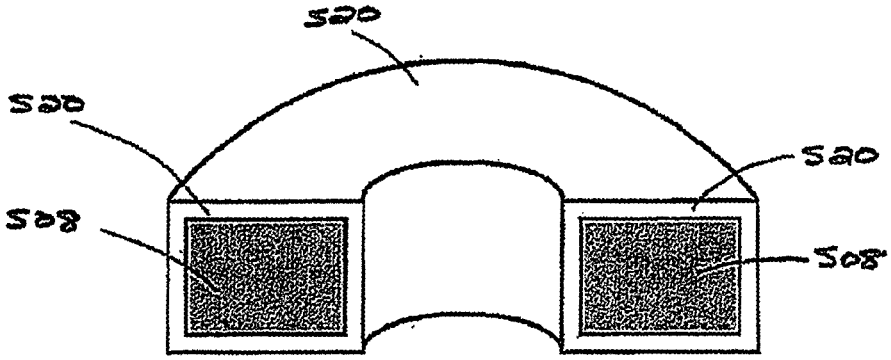
FIG. 8B is a partial cross-sectional view of the ion optical element of FIG. 8A.
Figure 8C:
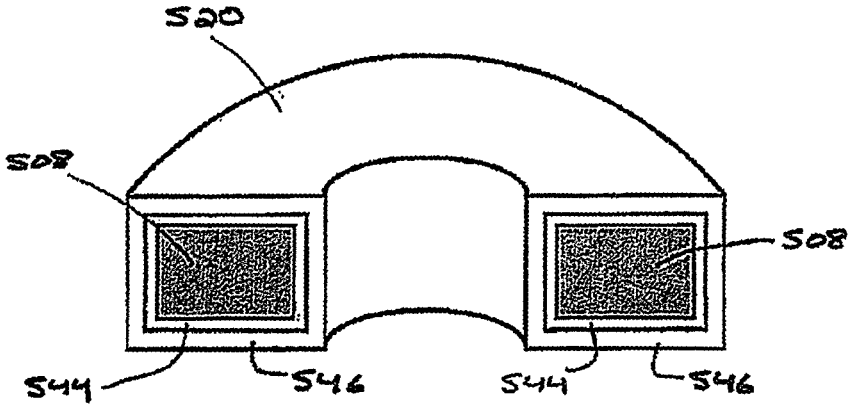
FIG. 8C is a partial cross-sectional view of another exemplary embodiment of an ion optical element according to the applicant's teachings.

FIGS. 8A-8B illustrate one exemplary embodiment of a ring-shaped electrode ion optical element 500 according to the applicant's teachings. As shown, the ring electrode 500 is formed from a core 508 having an electrically-conductive coating 520 disposed thereon. The core 508 can comprise any of a variety of materials, such as materials that are inexpensive and easy to machine with high precision. For example, the core material can comprise a printed circuit board material. The electrically-conductive coating 520 can comprise any of a variety of non-oxidizing electrically-conductive materials, such as gold, nickel, platinum, palladium, titanium, molybdenum, and various alloys or combinations thereof. In some embodiments, as shown in FIG. 8C, the electrically-conductive coating 520 can include a plurality of layers 544, 546. In the illustrated embodiment, a first base layer 544 is deposited directly onto the core 508, and a second layer 546 is deposited onto the first layer 544. In some embodiments, the base layer 544 can comprise copper and the second layer 546 can comprise gold.

The electrically-conductive coating 520 can be applied to any of a variety of thicknesses depending on the requirements of a particular application. In some embodiments, the thickness of the electrically-conductive coating 520 can be at least about 2 microns, at least about 4 microns, at least about 10 microns, at least about 50 microns, at least about 100 microns, and/or at least about 1000 microns. In some embodiments, thinner coatings can be used, e.g., as small as a monolayer of conductive material (~0.1 nm).

Figure 9:
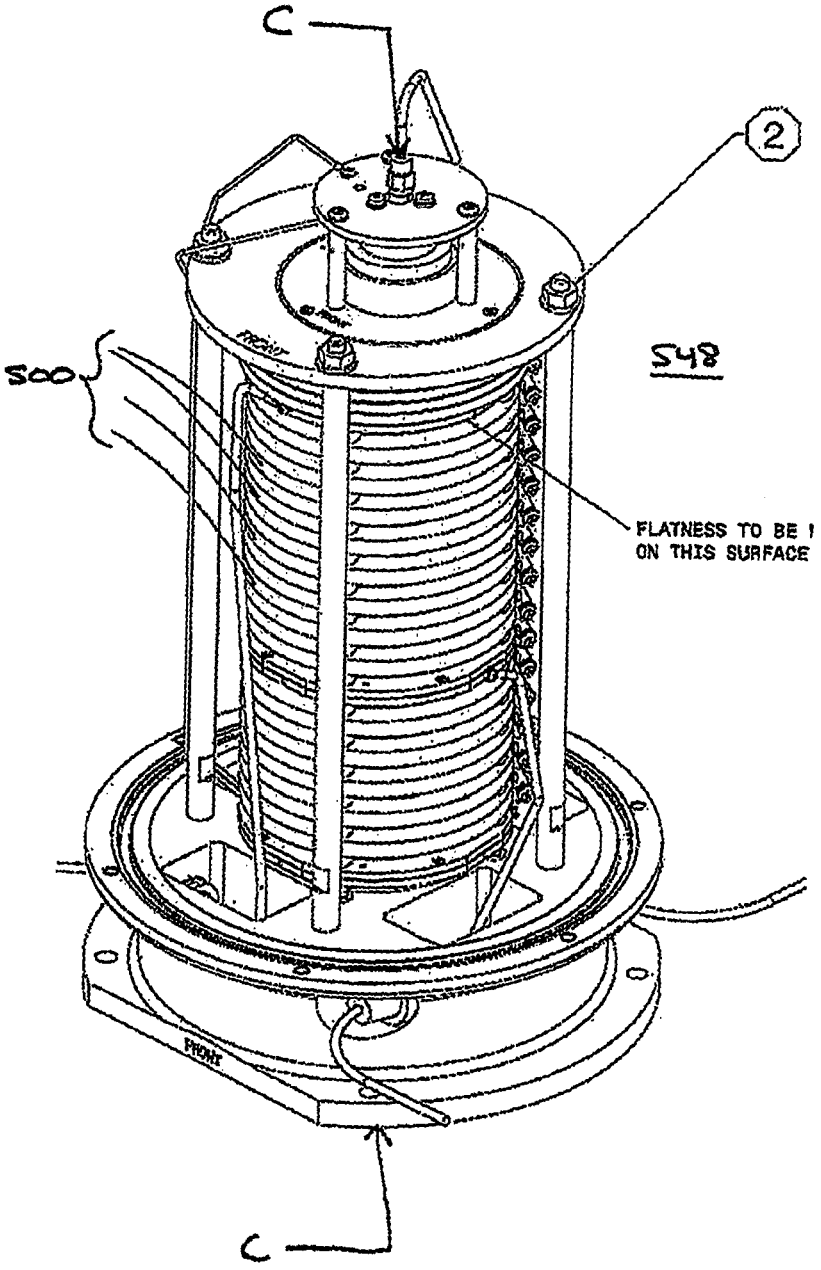
FIG. 9 is a schematic perspective view of one exemplary embodiment of an ion optics device constructed from a plurality of the ion optical elements of FIG. 8A.

As shown in FIG. 9, a plurality of ion optical elements 500 can be constructed as described above and positioned in a spaced relationship such that the central apertures of each element 500 define a channel C through which an ion beam can be directed. The assembled ion optical elements 500 can be positioned within a vacuum chamber or region 548 of a mass spectrometer and electric potentials can be applied thereto to generate an electromagnetic field within the channel C. The electrically-conductive coating 520 can be disposed over a selected surface area of the core 508 of each element 500 such that the coating 520 substantially prevents outgassing from said core 508 under vacuum conditions. In other words, the outgassing from the core material under the vacuum conditions typically encountered in a mass spectrometer can be limited to a degree that does not materially affect the results of an analysis performed by the mass spectrometer and/or to a degree that does not prevent the mass spectrometer from pumping down.

In some embodiments, the coating 520 can be applied over the entire external surface area of the core 508, such that no portion of the core 508 is exposed, in order to substantially prevent outgassing. In other embodiments, less than the entire external surface area of the core 508 can be coated, while still substantially preventing outgassing. For example, a minimal gap of uncoated surface area can be left to permit different voltages to be applied to the inside conductive surfaces or to separate pads to which resistors can be soldered. In some exemplary embodiments, at least about 50%, at least about 60%, at least about 70%, at least about 80%, at least about 90%, at least about 95%, and/or at least about 99% of the surface area of the core 508 exposed to vacuum conditions can be coated to substantially prevent outgassing therefrom. In some embodiments, for example those in which less than the entire external surface area of the core 508 is coated, the material chosen for the core can comprise epoxies characterized by minimal outgassing under vacuum conditions. In addition, in such embodiments, dimensional stability can be maintained to a greater degree to ensure that the positions of the active lens surfaces do not move with time.

While a ring-shaped ion optical element 500 is illustrated in FIGS. 8A-8C, it will be appreciated that any of a variety of ion optical elements having any of a variety of shapes can be constructed from a core and coating as described above.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. An ion optical element, comprising:

a substrate comprising:

first and second opposed surfaces;

a plurality of protrusions extending from said first surface, each protrusion having a top surface, at least one sidewall, and an electrically-conductive coating disposed on said top surface and at least a portion of said at least one sidewall; and at least one recess separating said protrusions, each recess having a portion of said first surface as a floor thereof;

wherein a depth of each recess is at least about one half of a width of said recess.

2. The ion optical element of claim 1, wherein said top surface of at least some of said protrusions is planar or curved or perpendicular to said at least one sidewall.

3. The ion optical element of claim 1, wherein said at least one sidewall of at least some of said protrusions is curved.

4. The ion optical element of claim 1, wherein at least some of said protrusions include an electrically-conductive via extending through the substrate from the electrically-conductive coating of the protrusion to an electrically-conductive pad formed on said second surface.

5. The ion optical element of claim 4, wherein the electrically-conductive via extends from a portion of the electrically-conductive coating disposed on either, the top surface of the protrusion or on the at least one sidewall of the protrusion, to said pad.

6. The ion optical element of claim 4, wherein said pad is coupled to at least one of a resistor, a resistive film, and a power supply configured to apply an electric potential thereto.

7. The ion optical element of claim 1, further comprising a vent extending through the substrate from the floor of said at least one recess to the second surface that permits gas flow therethrough.

8. The ion optical element of claim 1, wherein the substrate comprises any of an electrically-insulating material and a semi-conducting material.

9. The ion optical element of claim 1, wherein the substrate comprises any of ceramics, organic polymers, glass, machinable ceramics, and materials used in 3D printing.

10. The ion optical element of claim 1, wherein the substrate comprises a printed circuit board material.

11. The ion optical element of claim 10 wherein the printed circuit board material is selected from the group consisting of laminated polyamides, G-10, Teflon-based materials, phenolic cotton FR-2, and woven glass FR-4.

12. The ion optical element of claim 1, wherein the electrically-conductive coating comprises a non-oxidizing metal.

13. The ion optical element of claim 12 wherein the non-oxidizing metal comprises at least one of gold, nickel, platinum, palladium, titanium, and molybdenum.

14. The ion optical element of claim 1, wherein the ion optical element comprises at least one of a time-of-flight reflectron, a time-of-flight accelerator, an ion funnel, an ion tunnel, and an ion mobility column.

15. A method of manufacturing an ion optical element, comprising:

selectively removing portions of a printed circuit board substrate to generate a plurality of protrusions, said protrusions being separated from one another by a plurality of recesses each having a depth that is at least about one half of its width, each of said protrusions having a top surface and at least one sidewall;

depositing an electrically-conductive coating on said top surface and at least a portion of said at least one sidewall of each of said protrusions; and forming a non-coated region between each of said protrusions such that the protrusions define a plurality of discrete electrodes.

16. The method of claim 15, wherein said electrically-conductive coating is deposited using at least one of electroplating and vapor deposition.

17. The method of claim 15, wherein each of said non-coated regions is formed by applying a mask to said non-coated region before depositing the electrically-conductive coating and removing the mask after depositing the electrically-conductive coating.

18. The method of claim 15, wherein each of said non-coated regions is formed by depositing the electrically-conductive coating over floor surfaces of said recesses, and then selectively removing said coating from said floor surfaces.

19. The method of claim 15, wherein each of said non-coated regions is formed by etching portions of the electrically-conductive coating.

* * * * *